US007678980B2

(12) United States Patent
Rozier

(10) Patent No.: US 7,678,980 B2
(45) Date of Patent: Mar. 16, 2010

(54) END BLOWN FLUTE HAVING AN ACOUSTIC AIR SPACE

(76) Inventor: Claude Rozier, 66-24 Selfridge St., Forest Hills, NY (US) 11375

( * ) Notice: Subject to any disclaimer, the term of this patent is extended or adjusted under 35 U.S.C. 154(b) by 9 days.

(21) Appl. No.: 12/156,630

(22) Filed: Jun. 3, 2008

(65) Prior Publication Data

US 2009/0293701 A1 Dec. 3, 2009

(51) Int. Cl.
*G10D 7/02* (2006.01)

(52) U.S. Cl. ..... 84/384

(58) Field of Classification Search ..... 84/380 R, 84/383, 384, 385 A, 380 A, 387 R, 398, 399
See application file for complete search history.

(56) References Cited

U.S. PATENT DOCUMENTS 444,830 A 1/1891 Guenther
594,735 A 11/1897 Giorgi
3,866,507 A * 2/1975 Eajardo ..... 84/384
3,888,154 A 6/1975 Wesley, Sr.
4,422,364 A 12/1983 La Volpa
4,685,373 A * 8/1987 Novo ..... 84/464 A
5,014,585 A * 5/1991 Wesley, Sr. ..... 84/384

* cited by examiner

*Primary Examiner*—Kimberly R Lockett

(57) ABSTRACT

The present invention is directed to musical instruments that are based on the operation of an air reed and, in particular, encompasses end-blown flutes comprising an acoustic air space and a fluid air space. The communication between the acoustic and fluid air spaces is positioned so as to minimally interfere with the flow of air introduced, i.e., blown, into the fluid space and enables the instrument to produce rich, in-tune tones across a three octave range. The acoustic air space is formed by a hollow tuning chamber positioned opposite the air reed. In alternate embodiments, the invention encompasses a head-joint of a musical instrument, which head joint comprises a an acoustic space and a fluid space. The head joint of the invention may be used to replace or in place of the head joint or mouthpiece of common musical instruments of the woodwind family, e.g., the Western flute, saxophone, clarinet, oboe, nay, shakuhachi, or recorder.

9 Claims, 4 Drawing Sheets

END BLOWN FLUTE HAVING AN ACOUSTIC AIR SPACE

1. FIELD OF THE INVENTION

Figures 1A, 1B, 1C, 2A, 2B, 2C:
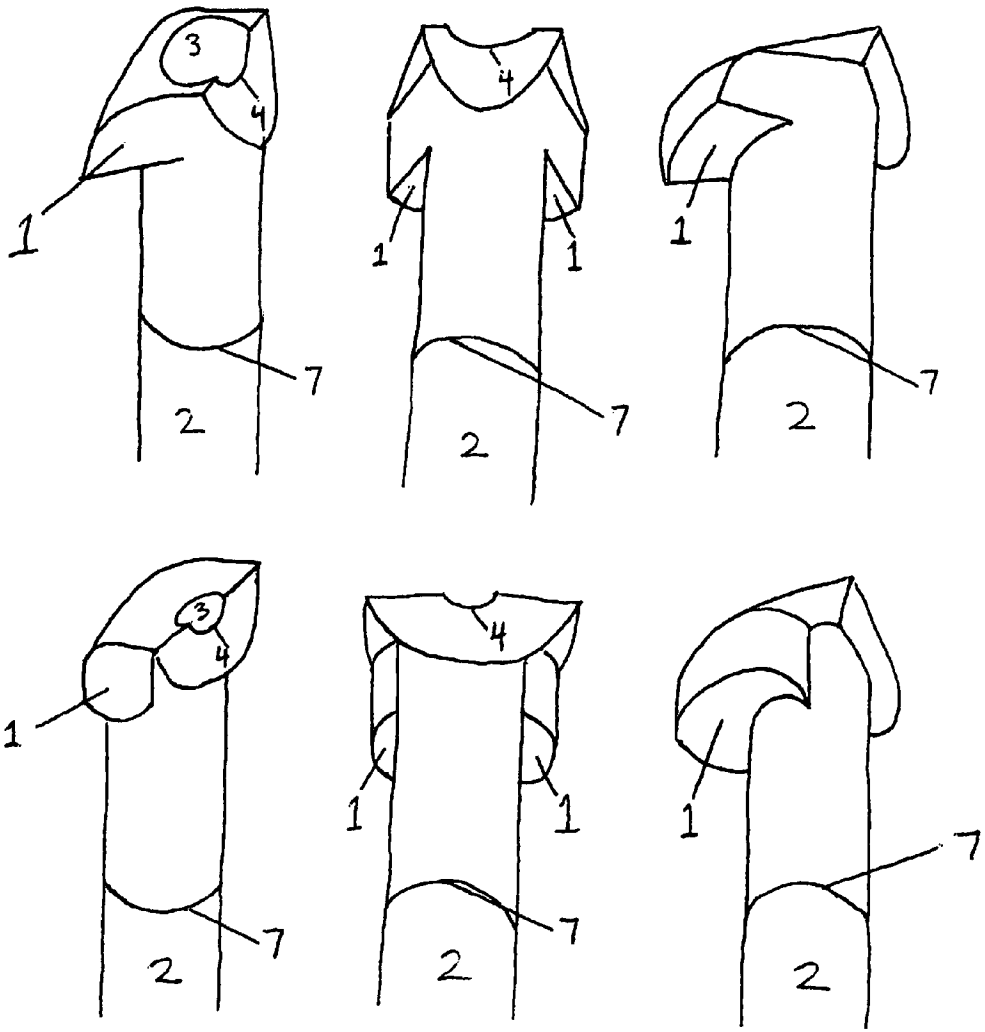

The present invention is directed to musical instruments that are based on the operation of an air reed and, in particular, encompasses end-blown flutes having a sound chamber comprised of an acoustic space and a fluid space. The acoustic space is positioned so as to minimally interfere with the flow of air within the fluid space and enables the instrument to produce rich, in-tune tones across a three octave range. In alternate embodiments, the invention encompasses a head-joint of a musical instrument, which head joint comprises a sound chamber having an acoustic space and a fluid space. The head joint of the invention may be used to replace or in place of the head joint or mouthpiece of common musical instruments of the woodwind family, e.g., the Western flute, saxophone, clarinet, oboe, nay, shakuhachi, etc.

2. BACKGROUND OF THE INVENTION

The present invention is directed to musical instruments, commonly known as flutes, that are based on the operation of an air reed. The sounds produced by a flute arise due to the impingement of air on an edge, known as the air reed, causing the air to oscillate as it passes into a sound chamber, producing an audible tone. The two primary categories of flutes include tubular flutes (for example, those of the modern Boehm flute family (i.e., the orchestral flute family including C-flutes, piccolos, alto flutes, bass flutes, etc.), the recorder, the tin whistle, the quena, the nay, the shakuhachi, etc.) and enclosed vessel flutes (such as the ocarina). As used herein, the term "flute" does not encompass enclosed vessel flutes.

Tubular flutes generally employ sound chambers open at both ends, wherein the embouchure hole is one of the end-openings. This is in contrast to other woodwind instruments, e.g., the clarinet, saxophone, oboe etc., wherein the mouth of the player encloses and seals one end of the central bore of the instrument, forming a sound chamber open at only one end. The sound chamber of a tubular flute is relatively long and slender, and is shaped (or substantially shaped) like a tube or a truncated cone, and may optionally comprise one or more tone holes in the wall of the sound chamber, i.e., in the side wall of the instrument. The most well-known flutes in Western cultures are the orchestral transverse flutes, or Boem flutes, which comprise an embouchure hole in the side wall of the sound chamber rather than at the end of the tube as in an end blown flute such as a nay or shakuhachi. The placement of the embouchure hole requires the orchestral flute to be supported laterally to the player's side, at an approximately 90° angle relative to the vertical formed by the player's torso. Maintaining the constrained horizontal position is especially tiresome on the hands, arms and neck. After long periods of playing, it may become difficult to move the fingers properly to precisely control the finger holes and keys. Accordingly, repeated efforts have been made to redesign the transverse instrument and/or head-joint thereof such that it may be played in a vertical position (see e.g., U.S. Pat. Nos. 4,422,364; 3,888,154, each of which is hereby incorporated by reference in its entirety). Moreover, the tonality of the transverse flute is known to be adversely affected by placement of the embouchure hole and resulting streamlines of blown air entering the flute.

In transverse flutes, the air is blown against the air reed (which is formed from a section of the embouchure hole), enters the embouchure hole and is forced into a spiral course within the sound chamber at a right angle to its direction of entry. Part of the air entering the sound chamber is deflected towards a closed section of the sound chamber (i.e., toward the cork or stopper of a traditional Boem flute) and from there is again deflected back toward the embouchure hole and the remaining open end of the sound chamber (i.e., the portion of the sound chamber comprising one or more tone holes). This path creates a turbulent air-stream within the flute in the area of the embouchure hole, recognized to negatively affect the tonality of the flute. For example, the turbulent air-flow has been ascribed to cause a "hissing sound" (see, e.g., U.S. Patent Application Publication No: 2004/0255754, herein incorporated by reference in its entirety) or to cause out of tune progression into the higher harmonics (see, e.g., U.S. Pat. No. 594,735, herein incorporated by reference in its entirety).

Efforts to improve the air-flow within the sound chamber of transverse instruments in the area of the embouchure hole, and to thereby improve the tonality of the instrument across all octaves, have included redesigning the interior of the sound chamber to attempt to direct airflow in a laminar fashion (see, e.g., U.S. Pat. Nos. 5,261,308 and 5,435,221, each of which is hereby incorporated by reference in its entirety), redesigning the shape of the sound chamber in an attempt to promote laminar flow (see, e.g., U.S. Patent No.: 2004/0255754), redesigning the shape of the sound chamber and placement of tone holes (see, e.g., U.S. Pat. Nos. 4,714,000; and 6,259,010, each of which is hereby incorporated by reference in its entirety), and moving the embouchure hole to the end of the sound chamber (see, e.g., U.S. Pat. Nos. 444,830; and 594,735 each of which is hereby incorporated by reference in its entirety). The instant patent encompasses a solution to the turbulent flow and/or playing position considerations by, in effect, placing the air reed at the end of the sound chamber, forming an end-blown flute.

End-blown flutes traditionally encompass non-western flutes (such as, but not limited to the nay, the quasaba, the shakuhachi, e.g., a "shakuhachi-type flute") and, in certain embodiments, fipple flutes (e.g., the recorder, the tin whistle). To play an end-blown, shakuhachi-type flute (e.g., wherein the embouchure hole is formed from the open end of the central bore of the instrument and wherein the air reed is thus formed from a section of the side wall of the instrument) the player focuses air directly over the air reed using the lips. In contrast, fipple flutes employ an airway to focus the air over the air reed. However, relative to traditional Western transverse flutes, either fipple-type or shakuhachi-type end blown flutes suffer from weaknesses in playable tonal range, in particular, in the range of tones they are able to be played harmonically, or in-tune. For example, a flute designed to emit a strong lower register is often quite shrill in the upper register(s) because the player is forced to blow relatively hard to obtain upper register notes. Similarly, in such flutes the upper octaves tend to be out of tune in relation to the bottom octave, and higher notes can be difficult to reach. These weaknesses are corrected in the transverse flutes by extending and enclosing the tubular sound chamber beyond the embouchure (and, thus, air reed), effectively placing the air reed and embouchure in the side wall of the sound chamber, and forming an acoustic air space and fluid air space on opposite sides of the air reed (see, e.g., Arthur H. Benade *Fundamentals Of Musical Acoustics*, (Oxford University Press, New York, N.Y. 1976). Prior to the present invention, however, attempts to redesign an end-blown flute to encompass an acoustic air-space have failed to address the problem of turbulent air-flow at the embouchure hole. For example, U.S. Pat. No. 444,830 teaches an end blown flute comprising at least one lateral tuning chamber on the side of the air reed. The positioning of the chamber(s) places it (them) at least partially in the path of the blown air, creating disruption of the air flow as the air passes the chamber(s) before spreading downward to fill the open sound chamber. Accordingly, the instant invention addresses the tonality/harmonic weaknesses of end blown flutes in general.

3. SUMMARY OF THE INVENTION

It is an object of the present invention to provide a musical instrument or head-joint thereof that remedies the above described deficiencies of commonly available transverse and end-blown flutes. In particular, the present invention provides for an end-blown musical instrument, or head-joint thereof, that is capable of producing both a harmonic progression of tones and excellent tone equality or equalization over at least three registers.

The present invention provides for a musical instrument and/or a head joint thereof played in the manner of an end-blown flute, comprising at one end of the sound chamber an embouchure hole, an air reed and a hollow or partially hollow tuning chamber, which tuning chamber forms an acoustic air space and is positioned opposite to said air reed. The tuning chamber is positioned such that the acoustic air space does not interfere, or only minimally interferes, with the air stream of blown air introduced across the air reed and into the fluid space of the instrument's sound chamber. The arrangement of air reed and tuning chamber allows the instrument to produce harmonic tones over at least three registers. Additionally, a head joint of the present invention may be used with existing musical instruments including the Boem flute, allowing transverse instruments to be played as end-blown instruments.

The present invention relates to musical instruments, in particular, wind instruments, or head-joints thereof, played in the manner of an end-blown flute, comprising an air reed and an acoustic air space at one end of a hollow sound chamber, which acoustic air space is positioned such that it does not interfere, or only minimally interferes, with the air stream of blown air introduced across the air reed. The instrument therefore comprises a sound chamber comprising a central tubular or conical bore and, in communication therewith, a closed or partially closed hollow or partially hollow tuning chamber. The sound chamber and tuning chamber define and/or contain the fluid air-space and the acoustic air-space, respectively, of the instrument. In preferred embodiments, the communication between the tuning chamber and central bore of the instrument, i.e., the communication between the acoustic and fluid air spaces, is positioned on the posterior surface (i.e., back) of the instrument, directly opposite the air reed. In related embodiments, the air reed is preferably located at or on the anterior surface, or front, of the instrument. As understood by one of skill in the art, because musical instruments, and or head joints thereof, are generally formed from tubes, the phrases "anterior surface" and "posterior surface" as used herein do not refer to independent planar surfaces, as in the opposite sides of a box, but rather relative positions on the single tubular surface of the instrument (i.e., on the wall of the sound chamber) when held in the playing position. Accordingly, as used herein, the phrase "anterior surface of the instrument" refers to the surface of the instrument, or that section of the sound chamber, that does not face the body of the player when the instrument is held in the playing position. In preferred embodiments, the tuning chamber of the invention is not a lateral extension but is rather located on the posterior, or back, of the instrument, or towards the body of the player, at or near the end of the instrument comprising the air reed.

In preferred embodiments, the tuning chamber is located at the proximal end of the instrument, at or near the embouchure hole. In some embodiments, the at least part of the embouchure hole forms an air reed, for example, as in the manner of a shakuhachi. Positioning the tuning chamber at the end of the instrument with the communication of the acoustic air space to the central bore of the instrument at and/or on the posterior of the instrument minimizes disruption of the introduced air stream across the air reed. Because the air reed is located at or on the anterior surface of the instrument, (see, e.g., air reed as Item 4, in FIG. 1A, FIG. 1B, FIG. 2A and FIG. 2B), when the air stream is blown into the instrument it will flow along the anterior internal surface of the central bore before spreading to fill the remainder of the sound chamber (e.g., as depicted in item 5, FIG. 3A and FIG. 3B). The design of the instant invention therefore minimizes the interaction of the acoustic air space within the tuning chamber and the fluid air space within the sound chamber, i.e., that formed by the central bore of the instrument, minimizing or eliminating turbulent air flow in the vicinity of the air reed. The positioning of the tuning chamber relative to the air reed encompassed by the invention thus allows and maintains laminar-like flow within the sound chamber's fluid air space below the air-reed.

In certain embodiments, the air reed is located at the proximal end of the instrument and the embouchure hole comprises said air reed (see, e.g., FIG. 1A and FIG. 2A). For example, in shakuhachi-type end blown flutes, the embouchure hole is the proximal open end of the flute, but which hole also extends to a section of the side wall of the instrument; the air reed is formed by thinning and sharpening the "cut away" section of the side wall of the tubular instrument. In specific examples of this embodiment, e.g., an embouchure comprising an air reed, e.g., in the manner of a shakuhachi, the air reed is located on the anterior portion of the embouchure hole and thus on the anterior surface of the instrument. The introduced air is then blown across the air reed creating the air stream along the anterior internal surface of the instrument. In alternate embodiments, the embouchure does not comprise an air reed and the air reed is located in the anterior surface of the instrument distal to the embouchure in the manner of a fipple-type flute, e.g., a recorder. Thus, in certain embodiments, the embouchure hole is proximal to the sound chamber. In specific examples related to this embodiment, i.e., an embouchure hole separate from and proximal to the air reed, an airway directs the air stream toward the air reed in the anterior side-wall of the instrument. Accordingly, the tuning chamber may be located directly opposite the air reed and not at the terminal proximal end of the instrument.

The hollow or partially hollow tuning chamber is of sufficient interior volume to allow accurate intonation of the instrument across at least a three octave range and, in particular, to enable the correct tuning of the $3^{rd}$ octave relative to the first and/or second octave(s). The tuning chamber may be of any shape such that the communication between the fluid air space and acoustic air space, i.e., that air space contained within the central bore of the instrument (the sound chamber) and the tuning chamber, respectively, is located on the posterior of the instrument and which communication minimally affects the air stream within the instrument of air introduced across the air-reed. Because the tuning chamber is on the posterior of the instrument, or toward the face of the player, in order for the acoustic airspace to have sufficient volume, in some embodiments, the tuning chamber is not cylindrical or tubular. In preferred embodiments, the tuning chamber and/or the communication between the acoustic air-space and the fluid airspace is located on the posterior of the instrument and opposite the air reed. In certain embodiments, compressing the shape of the tuning chamber in the vertical dimension will reduce the area of communication between the fluid and acoustic air spaces and further minimize any turbulent interaction between the two. Variation of the volume and shape of the tuning chamber, and of the shape of the communication between the tuning chamber and central bore according to the description and methods presented herein are within the ordinary skill of one in the art of instrument design and/or construction.

The shape and positioning of the tuning chamber must allow the instrument and/or head joint thereof to be held to the lips or against the face of the musician so that it may be comfortably played in the manner of an end-blown flute. In certain embodiments, positioning the tuning chamber on the posterior surface at the proximal end of the instrument places the tuning chamber in contact with the musician's face under the lower lip, allowing the proximal surface of the tuning chamber to be used as a surface to stabilize the flute against the face (see, e.g., FIG. 3A). Because the proximal surface of the tuning chamber is, in certain embodiments, in intimate contact with the musician's face, the proximal surface of the tuning chamber may, in accordance with such embodiments, be left at least partially open and shaped to receive the lower face, i.e., under the lower lip, of the musician, sealing said partially open surface (see, e.g., exemplary differently sized embouchure openings 3*a* and 3*b* in FIG. 4A). This may allow the musician to define the proximal surface, e.g., the "top," of the tuning chamber with the lower face, permitting the musician to control both tuning chamber volume and the shape of the interface between the acoustic and fluid air spaces, and may allow a greater control over the tonality of the instrument relative to that achieved with a completely closed tuning chamber.

The shape of the tuning chamber may thus be quite variable in accordance with the methods described herein, but such variations are fully encompassed by the invention in that they represent the result of routine experimentation by one of skill in the art according to the methods and descriptions presented herein. In certain embodiments, the volume of the acoustic air space, i.e., the inner volume of the tuning chamber, is adjustable so that the tuning of the instrument can be modified by the player. In specific examples in accordance with these embodiments, one or more walls of the tuning chamber defining the acoustic air space (including any such walls as would commonly be termed a bottom or top) are moveable and/or otherwise variable in position. In yet other examples, inserts may be used such that, when fitted into or removed from the acoustic chamber, the volume of the acoustic air space is modified, e.g., increased or decreased.

In certain embodiments, the invention encompasses a sound chamber comprising a plurality of tone holes in the side wall of the instrument and in communication with the instrument's central bore. Opening or closing the tone holes allows the musician to alter the pitch of the tone produced by the instrument. Opening and/or closing the tones holes may be accomplished directly, e.g., by use of the fingers, or indirectly by use of a series of levers, arms and pads as is well known in the art. The instrument of the invention may comprise multiple pieces including a head-joint as described herein, e.g., a head-joint comprising an air reed and a tuning chamber according to the methods of the invention. In alternate embodiments, the invention encompasses a head-joint played in the manner of an end-blown flute comprising an air reed and tuning chamber as herein described, which head joint may be used with the bodies, i.e., sound chambers, of musical instruments known in the art. As encompassed by the instant invention, the head-joint as described herein may or may not be removable from the body of the instrument. In embodiments of the invention comprising a removable head-joint, the distal end of the head joint may be adapted such that it may replace or be used in place of the head-joints and/or mouthpieces of existing musical instruments. Non-limiting examples of instruments which may be adapted to comprise the head-joint of the invention, or be adapted to be used with the head joint of the invention, include traditionally Western instruments (including flutes, clarinets, oboes, saxophones, fipple flutes (e.g., tin whistles, recorders)) as well as traditionally end-blown flutes (including the nay, shackuhatchi, etc.). In certain embodiments, the instrument of the invention and/or head-joint thereof is not straight and may be curved or comprise bends that allow the sound chamber of the instrument to be held and played in a non-vertical orientation (see, e.g., FIG. 4B).

As used herein, the term "embouchure" and "embouchure hole" are used interchangeably and encompass the opening of an instrument through which air is introduced, e.g., blown. In certain embodiments, the embouchure of the instrument of the invention, and/or head-joint thereof, comprises an air reed, e.g., as in a Boem flute or shakuhachi. As understood by one of skill in the art, in such instruments, a section of the wall forming the embouchure hole is the air-reed. In other embodiments, the embouchure does not comprise an air reed and is the opening through which air is introduced into an airway that directs the air stream over the air reed in the manner of a fipple-type flute. In preferred embodiments, the air reed is located in/on the anterior surface of the instrument.

As used herein, the term "proximal" and analogous terms refers to that portion of the instrument close to or near the embouchure hole and, thus, close to or near the mouth and face of the musician when the instrument is held in the playing position. As used herein, the term "distal" and analogous terms are the opposite of proximal and refer to the portion or portions of the instrument along the length of the instrument that are away from face and/or mouth of the musician when the instrument is held in a playing position. Normally, the terms "proximal" and/or "distal" are used to describe the positioning of a first component of the instrument relative the positioning of a second component. For example, embodiments wherein the embouchure is described as proximal to the position of the air reed describe embodiments wherein the embouchure is located closer to the face/mouth of the musician than is the air reed (e.g., as in the case of a fipple flute); in differing terms, the air reed is distal to the tuning chamber.

The instrument and or head joint as described herein may be formed from any material suitable for the construction of a musical instrument. As is well known in the art, such materials include, but are not limited to, wood, metal, plastic, resin, rubber, ceramic materials, composites, etc.

3.1 BRIEF DESCRIPTION OF THE DRAWINGS

FIG. 1A-FIG. 1C. Head-joint of an end-blown flute comprising a tuning chamber viewed from differing perspectives. (A) Perspective allowing a view of proximal surfaces of head-joint. (B) Perspective allowing view of anterior surface of the head joint with a partial view of the distal surfaces of the tuning chamber. (C) Perspective allowing view of underside (i.e., distal surface) of the tuning chamber.

FIG. 2A-FIG. 2C. Head-joint of an end-blown flute comprising a tuning chamber viewed from differing perspectives. (A) Perspective allowing a view of proximal surfaces of headjoint. (B) Perspective allowing view of anterior surface of the head joint with a partial view of the distal surfaces of the tuning chamber. (C) Perspective allowing view of underside (i.e., distal surface) of the tuning chamber.

Figure 3A:
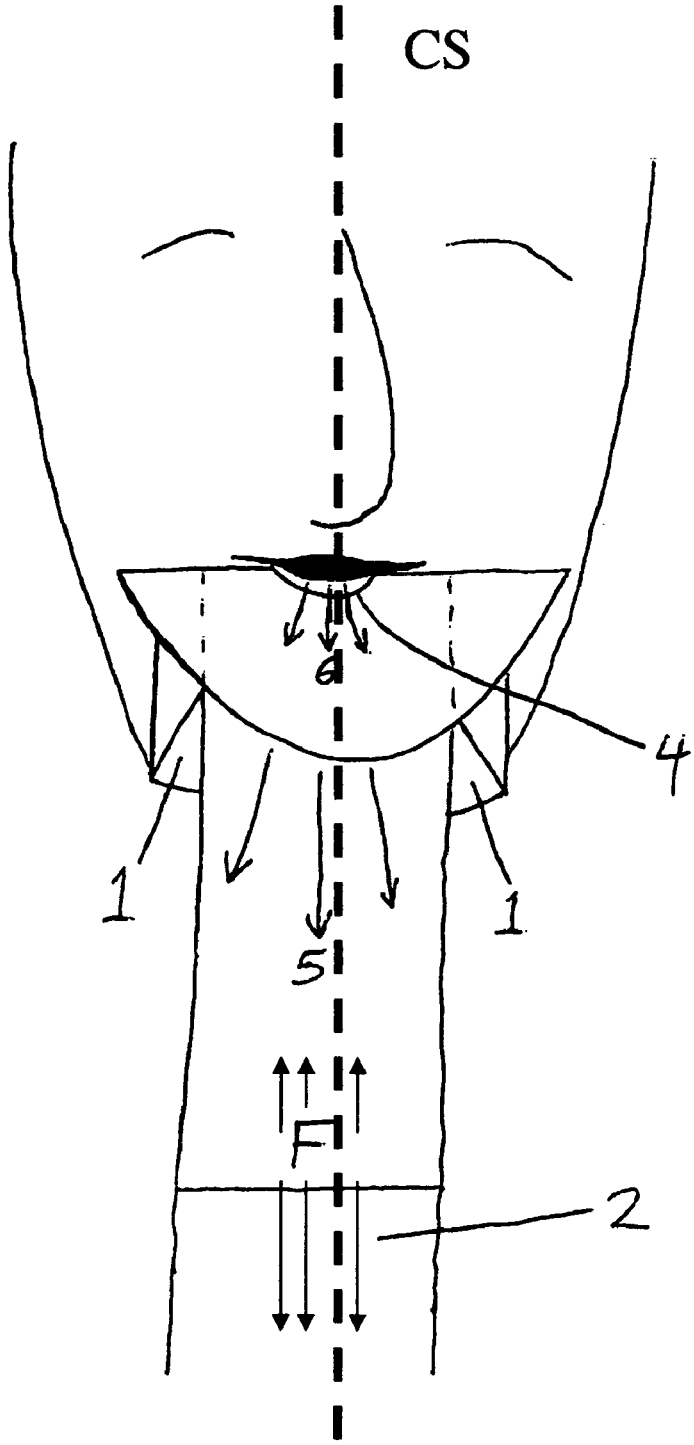
Figure 3B:
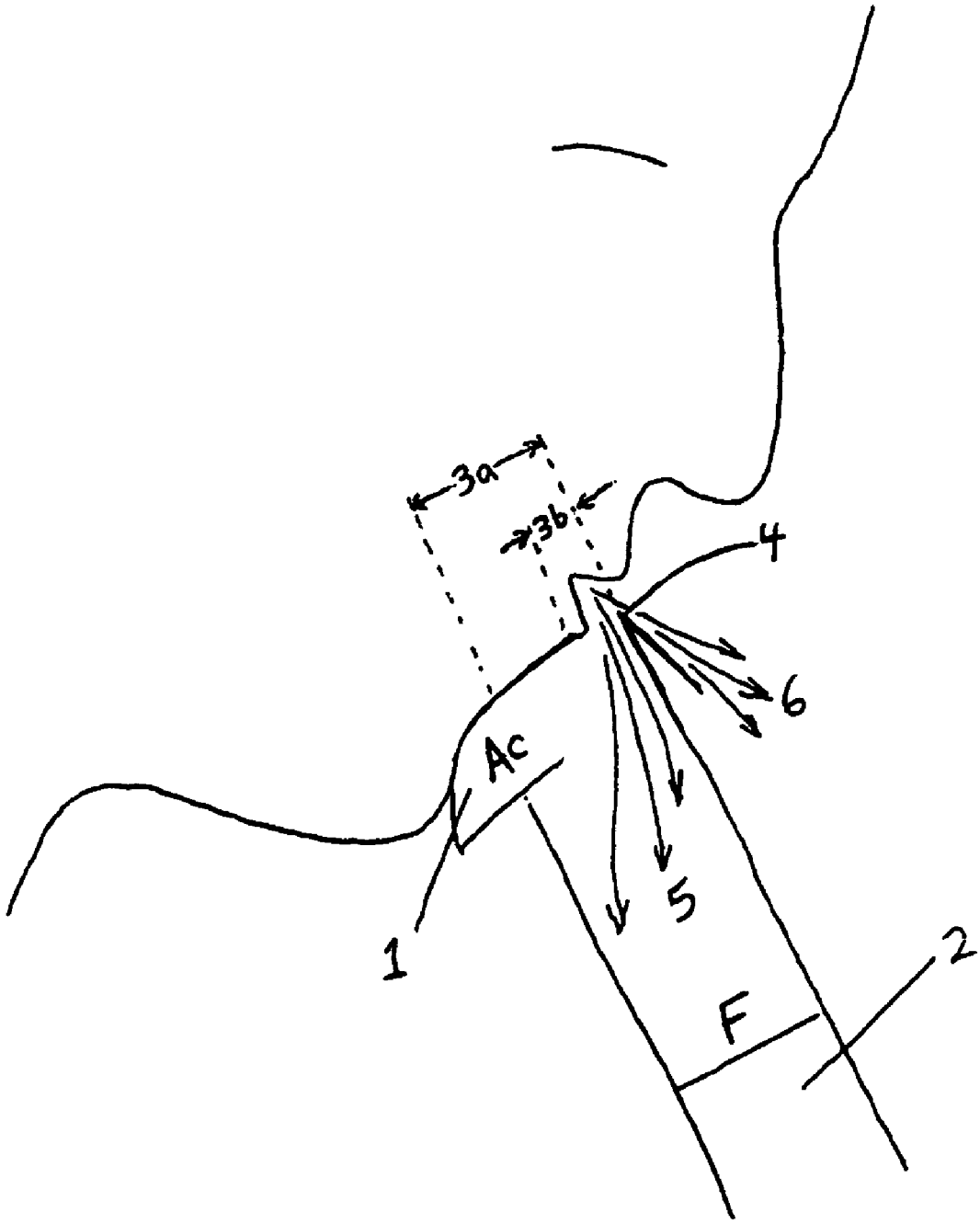

FIG. 3A-FIG. 3B. View of head-joint of instrument and player's face when instrument is held in a playing position. (A) Perspective allowing view of anterior surfaces of the instrument and/or head joint. (B) Cross section of (A), sagittal plane through line "CS" in (A).

Figure 4B:
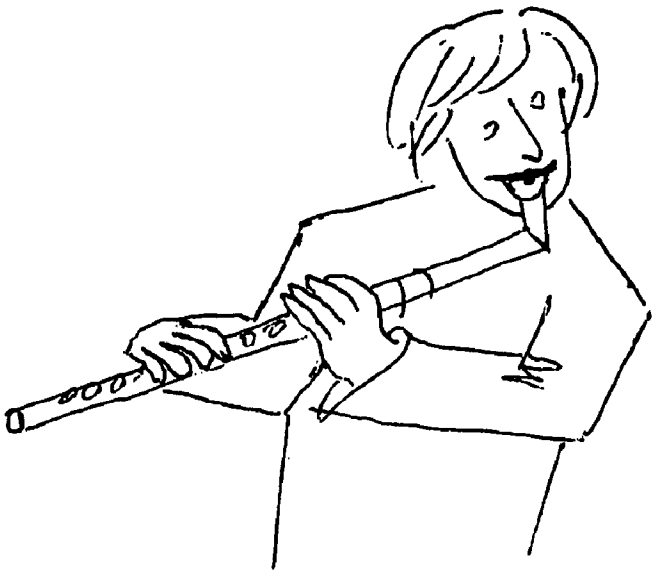
Figure 4A:
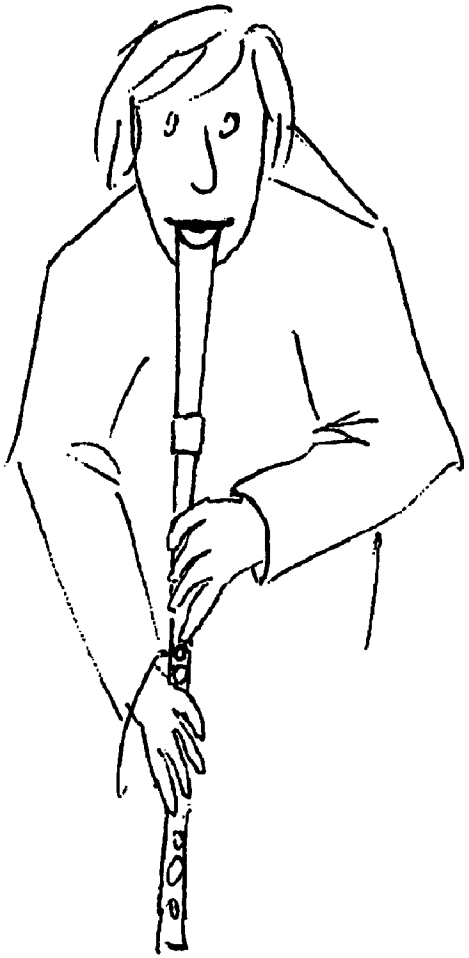

FIG. 4A-FIG. 4B. Representative figures showing specific embodiments of differing playing positions encompassed by the present invention. (A) Vertical playing position, typical of end-blown flutes; (B) Horizontal playing position, typical of transverse flutes, effected by having a curved headjoint.

4. DETAILED DESCRIPTION

Embodiments of the present invention are described below with reference to FIG. 1A to FIG. 4B.

In the drawings, reference numeral 1 denotes the tuning chamber that is formed at the proximal end of a musical instrument, e.g., a flute. The tuning chamber may be a component of the head-joint of the instrument, or may be a component of the instrument itself where the instrument does not comprise a separable head-joint as described herein. Reference numeral 2 denotes the body of the instrument comprising a fluid air space (F), i.e., that air space generally defined by the sound chamber and central bore of the instrument. Reference numeral 3 denotes the embouchure hole, which hole is located, at least in part, through the proximal surface of the tuning chamber, and reference numeral 4 denotes the air reed on the anterior surface of the head-joint and/or instrument, which, in some embodiments, is formed from a portion of the embouchure hole. Reference numeral 7 denotes the point of joining between the head-joint and body of the instrument. In certain embodiments, the instrument of the invention does not comprise a separable head-joint.

As depicted in FIG. 1A to FIG. 2C, in specific embodiments, the tuning chamber (reference numeral 1) is positioned on the posterior surface at the proximal end of the flute. In one aspect in accordance with this embodiment, the proximal surface of the tuning chamber forms a surface against which the lower face of the instrument player is positioned (see, e.g., FIG. 3B). An air-stream is then directed by the lips of the player against the air reed (reference numeral 4), causing at least part of said air-stream to be directed into the instrument. For example, an air stream directed through the lips of the player impinges the air reed and is made to flow in the arrow mark directions 5 and 6 as indicated in FIG. 3A. The air-stream caused by the breath of the player comprises an inflow component 5 and an outside component 6 (FIG. 3A-FIG. 3B).

In preferred embodiments, the tuning chamber is positioned on the posterior surface of the head-joint and/or instrument at its extreme proximal end to minimize turbulent communication of the airflow between the acoustic and fluid air-spaces (see, e.g., FIG. 3B). The relative positioning of the air reed (reference numeral 4) and the acoustic chamber (reference numeral 1) allows the air stream entering the head-joint and/or instrument to be directed against the anterior, interior surface of the sound chamber of the instrument, and/or head joint thereof, forming a laminar flow (component of the inflow; reference numeral 5) with minimal interaction from the acoustic air space.

The tuning chamber creates within the head-joint and/or instrument two air spaces, an acoustic space (Ac) and a fluid space (F) (FIG. 3A-FIG. 3B). The air stream directed into the instrument is, in part, a laminar-like flow (reference numeral 5) that spreads to fill the fluid space (F) of the sound chamber. Interference by the acoustic air space on the air-flow within the fluid air space (F) is minimized, preventing irregular flow in the fluid airspace and enabling the formation of laminar-like flow in the sound chamber. In particular, the design of the positioning of the acoustic air-space and the air reed minimizes or eliminates turbulent flow at or near the air reed and/or embouchure of the instrument. However, because the boundary of the two spaces is a gaseous wall, the two air-spaces can interact to enable the production of rich, vigorous tones that are harmonic across at least three octaves, which, in particular, allows the correct tuning of the instrument in the third octave relative to that of the first and/or second octave (s).

Because of the aforementioned intimate contact between the proximal surface of the tuning chamber and the lower face of the player, the embouchure hole may be designed to receive at least part of the lower face of the player. As an example, FIG. 2 depicts a head-joint and/or instrument of the invention wherein the embouchure is of suitable size to allow the player to direct an appropriate air-stream against the air reed; in sectional view, such an embouchure hole may be represented by the distance depicted by 3*b* in FIG. 3B. In contrast, FIG. 1A depicts a relatively larger embouchure hole, wherein the proximal surface of the tuning chamber is sealed, at least in part, by the lower face of the player; such an embouchure hole may be represented by the distance depicted by 3*a* in FIG. 3B.

As exemplified in comparing FIG. 1 and FIG. 2, the tuning chamber may be of variable size and geometry in order to form a suitable acoustic air-space to allow the proper tuning of the instrument across three octaves. In particular, the volume of the tuning chamber is such that the $3^{rd}$ or higher octave(s) of the instrument are correctly tuned relative to that of the $1^{st}$ and $2^{nd}$ octaves. In specific embodiments, the tuning chamber is of variable volume to allow adjustment by the player. Design modifications to enable such variable acoustic space volume or modifications to the size and shape of the tuning chamber are readily apparent to one of skill in the art.

The head-joint and/or instrument of the invention may be designed so that the sound chamber is held vertically in the manner of an end-blown flute, or may be designed such that the sound chamber is held in the manner of a transverse flute. In specific embodiments, the head-joint and/or instrument of the invention is designed to be played vertically in the manner of an end-blown flute (FIG. 4A). In other embodiments, the head-joint and/or instrument of the invention is designed to be played horizontally in the manner of a transverse flute (FIG. 4B)

It should be understood that the above description is only representative of illustrative examples of certain embodiments of the invention. For the reader's convenience, the above description has focused only on certain aspects of embodiments for the purpose of teaching the principles of the invention. Other embodiments may result from different combinations of the various aspects of the invention. The description has not attempted to exhaustively enumerate all possible variations. Since numerous modifications and variations will readily occur to those skilled in the art, it is not desired that the present invention be limited to the exact construction and operation herein illustrated. Accordingly, all suitable modifications and equivalents that may be accomplished using the teachings herein are intended to fall within the scope of the claims.

What is claimed is:

1. A head-joint of a wind instrument comprising an embouchure hole, an air reed on the anterior surface of the headjoint, a central bore and a tuning chamber, wherein the air space defined by the tuning chamber is in communication with said central bore and said tuning chamber is opposite said air reed.

2. The head-joint of claim 1, wherein said embouchure hole comprises said air reed.

3. The head-joint of claim 1, wherein said embouchure hole is proximal to said air reed.

4. The head-joint of claim 1, wherein said tuning chamber is of sufficient interior volume to enable correct tuning of the instrument in the $3^{rd}$ octave relative to the first and/or second octave.

5. A musical instrument comprising the head-joint of claim 1.

6. The musical instrument of claim 5, wherein the head-joint is removable.

7. The head-joint of claim 1, wherein said central bore is tubular or conical.

8. The head-joint of claim 2, wherein the proximal surface of the tuning chamber is partially open.

9. The head-joint of claim 2 or 8, wherein the proximal surface of the tuning chamber is shaped to receive a portion of the face and/or lower lip of a musician.

* * * * *